US010050348B2

(12) United States Patent
Kawaguchi et al.

(10) Patent No.: US 10,050,348 B2
(45) Date of Patent: Aug. 14, 2018

(54) ANTENNA DEVICE

(71) Applicant: DENSO CORPORATION, Kariya, Aichi-pref. (JP)

(72) Inventors: Kazushi Kawaguchi, Anjo (JP); Yuji Sugimoto, Kariya (JP); Masanobu Yukumatsu, Kariya (JP); Asahi Kondo, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 419 days.

(21) Appl. No.: 14/764,137

(22) PCT Filed: Dec. 11, 2013

(86) PCT No.: PCT/JP2013/083244
§ 371 (c)(1),
(2) Date: Jul. 28, 2015

(87) PCT Pub. No.: WO2014/119141
PCT Pub. Date: Aug. 7, 2014

(65) Prior Publication Data

US 2016/0013557 A1 Jan. 14, 2016

(30) Foreign Application Priority Data

Jan. 30, 2013 (JP) ..... 2013-015939
Jul. 26, 2013 (JP) ..... 2013-155661

(51) Int. Cl.
*H01Q 9/04* (2006.01)
*H01Q 1/38* (2006.01)
(Continued)

(52) U.S. Cl.
CPC ..... *H01Q 9/0407* (2013.01); *H01Q 1/38* (2013.01); *H01Q 1/52* (2013.01); *H01Q 17/00* (2013.01); *H01Q 21/08* (2013.01)

(58) Field of Classification Search
CPC ..... H01Q 9/0407; H01Q 1/38; H01Q 1/52; H01Q 21/08
(Continued)

(56) References Cited

U.S. PATENT DOCUMENTS 6,133,880 A * 10/2000 Grangeat ..... H01P 5/08 343/700 MS
6,262,495 B1 7/2001 Yablonovitch et al.
(Continued)

FOREIGN PATENT DOCUMENTS

JP H06-29721 A 2/1994
JP 2002-510886 4/2002
(Continued)

OTHER PUBLICATIONS

International Search Report (translated version); International Application No. PCT/JP2013/083244; filing date Dec. 11, 2013; 1 page.
(Continued)

*Primary Examiner* — Dameon E Levi
*Assistant Examiner* — David Lotter
(74) *Attorney, Agent, or Firm* — Knobble, Martens, Olson & Bear, LLP

(57) ABSTRACT

An antenna device 1 has a dielectric substrate 2, a patch antenna 5 and electric power absorbing passive elements 21, 24 formed on a surface of the dielectric substrate. Each electric power absorbing passive element 21, 24 is formed between the patch antenna 5 and an edge portion in a polarized wave direction of the dielectric substrate 2. The electric power absorbing passive elements 21, 24 absorb a part of electric power received by the patch antenna 5. This makes it possible to suppress a surface current flowing to the edge portions of the dielectric substrate on a conductive plate (a front-surface conductor plate 3 or a back surface conductor plate 4) on the dielectric substrate.

14 Claims, 13 Drawing Sheets

(51) Int. Cl.
*H01Q 21/08* (2006.01)
*H01Q 1/52* (2006.01)
*H01Q 17/00* (2006.01)

(58) Field of Classification Search
USPC ..... 343/905
See application file for complete search history.

(56) References Cited

U.S. PATENT DOCUMENTS

| | | | | |
|---|---|---|---|---|
| 2007/0152833 | A1* | 7/2007 | Kaplan | G06K 19/0702 340/572.8 |
| 2008/0284661 | A1* | 11/2008 | He | H01Q 9/0421 343/700 MS |
| 2014/0111684 | A1* | 4/2014 | Corbin | H01Q 1/243 348/374 |

FOREIGN PATENT DOCUMENTS

| | | | |
|---|---|---|---|
| JP | 2003-304113 | | 10/2003 |
| JP | 2006-261941 | A | 9/2006 |
| WO | WO2014/119141 | A1 | 8/2014 |

OTHER PUBLICATIONS

International Preliminary Report on Patentability; International Application No. PCT/JP2013/083244; Filed: Dec. 11, 2013 (with English translation).

* cited by examiner (a) STRUCTURE WITHOUT PASSIVE CONDUCTIVE PLATE (CONVENTIONAL CASE)

(b) STRUCTURE HAVING PASSIVE CONDUCTIVE SECTION (a) STRUCTURE WITHOUT PASSIVE CONDUCTIVE SECTION (PRIOR ART)

(b) STRUCTURE HAVING PASSIVE CONDUCTIVE SECTION (THE NUMBER OF PASSIVE CONDUCTORS IS SIX) (EXEMPLARY EMBODIMENTS)

(a) HORIZONTALLY POLARIZED WAVE ON HORIZONTAL SURFACE (x-z SURFACE)

(b) VERTICALLY POLARIZED WAVE ON HORIZONTAL SURFACE (x-z SURFACE)

(a)

(b) C-C CROSS SECTION (X-Z SURFACE)

ANTENNA DEVICE

CROSS-REFERENCE TO RELATED APPLICATION

This application is based on and claims the benefit of priority from earlier Japanese Patent Application No. 2013-015939 filed on Jan. 30, 2013 and Japanese Patent Application No. 2013-155661 filed on Jul. 26, 2013, the descriptions of which are incorporated herein by reference and made a part of the present disclosure.

BACKGROUND

Technical Field

The present invention relates to antenna devices having a patch antenna.

Background Art

A patch antenna formed on a dielectric substrate is used for radar devices mounted on vehicles and aircraft to monitor its surrounding environment. In general, the patch antenna has a structure in which patch radiating elements (conductors having a patch-like shape) are formed on a dielectric substrate. Further, a conductive section is formed on the other surface (back surface) of the dielectric substrate which is opposite to the surface (front surface) on which the patch radiating elements are formed. The conductive section acts as a base plate. Further, there is a possible case in which the conductive section is also formed at the edge portions on the front surface of the dielectric substrate in addition to the patch radiating elements.

In the operation of the patch antenna having the structure previously described, an electric field is generated between the patch radiating elements and the conductive section, and a surface current flows due to the generated electric field on the surface of the conductive section. The surface current flows to the edge portion of the dielectric substrate. Finally, the radiation occurs from the edge portions of the dielectric substrate (i.e. the edge portions of the conductive section). This radiation becomes unnecessary radiation which affects the performance of the patch antenna. That is, the radiation from the edge portion disturbs the directivity of the patch antenna.

On the other hand, a patent document 1 discloses a technique capable of suppressing a surface current flowing on the conductive section on the substrate. Specifically, a plurality of conductive patches is formed on most of the surface around the patch radiating elements on the surface of the dielectric substrate. Each conductive patch is electrically connected to the base plate on the back surface of the dielectric substrate through a conductive via. The formation of the conductive patches makes it possible to suppress the transmission of the surface current to the edge portions of the base plate.

CITATION LIST

Patent Literature

[Patent document 1] Japanese Translation of PCT International application Publication No. 2002-510886.

SUMMARY OF INVENTION

Technical Problem

The technique needs to form a plurality of the conductive patches on most of the surface of the dielectric substrate in order to suppress the propagation of the surface current. Further, the technique needs to provide the electrical connection between each conductive patch and the base plate of the back surface of the dielectric substrate through the corresponding conductive via. The technique provides a complicated structure, and also causes a complicated design. This makes it difficult to produce such antenna devices with a low manufacturing cost.

Further, because the conventional technique needs to have the plural number of vias penetrating the dielectric substrate, this limits the mountable flexibility of transmission lines and high frequency components to be arranged on the back surface of the dielectric substrate and in an intermediate layer of the dielectric substrate. That is, the conventional technique limits the design flexibility of the overall antenna device including the patch antenna, and the mountable flexibility of various transmission lines and high frequency components, etc.

The present invention has been developed addressing such problems, and an object of the present invention is to provide an antenna device having a simple structure capable of suppressing disturbance in directivity due to a surface current, and providing an improved design flexibility.

Solution to Problem

In order to solve the conventional problems, the antenna device according to the present invention has a dielectric substrate, a patch antenna formed on the dielectric substrate, and at least a first passive element formed on a surface of the dielectric substrate on which the patch antenna is formed.

The patch antenna has at least one patch radiating element to which an electric power is fed. A predetermined direction on the surface of the dielectric substrate is referred to as the main polarization direction. The first passive element is formed between the patch antenna and at least one of both edge portions in the main polarization direction of the dielectric substrate.

In the antenna device having the structure previously described, the first passive element absorbs part of the radio waves transmitted from and received by the patch antenna, and suppresses the surface current flowing toward the edge portions of the dielectric substrate. For this reason, it is possible to suppress unnecessary radiation from the edge portions of the dielectric substrate. This makes it possible to suppress disturbance in directivity of the patch antenna caused by the surface current and improve the design flexibility with a simple structure.

It is preferable for the first passive element to resonate at a frequency within a predetermined frequency range which contains an operating frequency of the patch antenna. The first passive element having the structure previously described makes it possible to suppress the transmission of the surface current toward the edge portions of the dielectric substrate with high efficiency.

It is preferable for the first passive element to have an energy consuming member capable of consuming electric energy induced by an external electric field.

When the energy consuming member consumes the electric energy absorbed by the first passive element, it is possible for the first passive element to provide a stable suppression effect of suppressing a surface current.

Reference numbers and characters in parentheses in the claims correspond to components and means used in the exemplary embodiments described later. However, the concept of the present invention is not limited by the components and means designated by the reference numbers and characters.

DESCRIPTION OF EMBODIMENTS

Next, a description will be given of preferred exemplary embodiments with reference to drawings. The concept of the present invention is not limited by concrete means and structure disclosed in the following exemplary embodiments. It is also possible to combine the exemplary embodiments and use a part of the structure of each exemplary embodiment.

Figure 1:
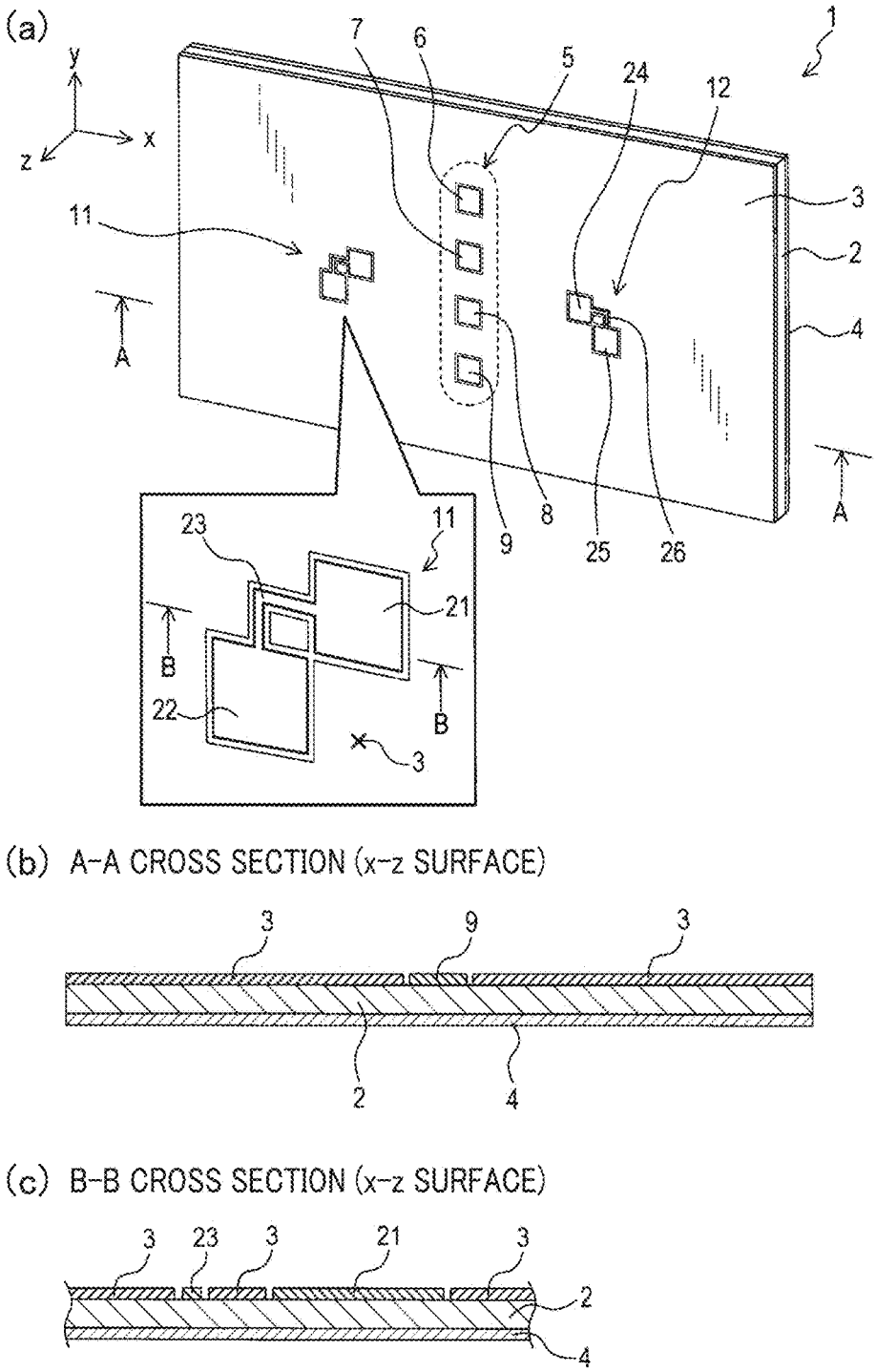
FIGS. 1(*a*), (*b*) and (*c*) show schematic structure of the antenna device according to a first exemplary embodiment.

First Exemplary Embodiment (1. Structure of antenna device) as shown in FIG. 1(*a*), the antenna device 1 according to the first exemplary embodiment has a structure in which a patch antenna 5 and two passive conductor sections 11 and 12 are formed on one surface (on the front surface) of a dielectric substrate 2 having a rectangle shape. The longitudinal direction (i.e. a lateral direction in FIG. 1(*a*)) of the dielectric substrate 2 indicates the x axis direction, and a short direction (vertical direction in FIG. 1(*a*)) is the y axis direction, and a direction perpendicular to the surface of the dielectric substrate 2 is the z axis direction.

For example, the antenna device 1 is arranged at a front side of a vehicle equipped with the antenna device 1 so that the front surface side of the dielectric substrate 2 faces the front forward direction of the vehicle, and the longitudinal direction of the dielectric substrate 2 of a rectangle shape becomes arranged parallel to the ground surface of a roadway. The antenna device 1 is used as a radar device to monitor a region in front of the vehicle. For this reason, a surface parallel to the longitudinal side of the dielectric substrate 2 is referred to as the horizontal surface (which is perpendicular to the y axis direction).

The patch antenna 5 has a structure in which a plurality of patch radiating elements 6, 7, 8 and 9 having a square shape, i.e. four patch radiating elements in the exemplary embodiment are arranged at a predetermined interval in the vertical direction (y axis direction) on the central section viewed along the longitudinal direction of the dielectric substrate 2.

A back surface conductive plate 4 is formed on the other surface (back surface) of the dielectric substrate 2. The back surface conductive plate 4 acts as a base plate of the patch antenna 5. Further, a conductive plate (front surface conductive plate) 3 is formed in the area on the front surface of the dielectric substrate 2, other than the formation area in which the patch antenna 5 and the passive conductor sections 11 and 12 are formed.

As can be clearly understood from FIGS. 1(*a*) and (*b*), a groove is formed between the front surface conductive plate 3 and each of the patch radiating elements 6 to 9. Each of the patch radiating elements 6 to 9 is physically separated to each other. As can be clearly understood from FIGS. 1(*a*) and (*c*), a groove is also formed around the whole circumference of each of the passive conductor sections 11 and 12. Through the grooves, the front surface conductive plate 3 is physically separated from each of the passive conductor sections 11 and 12. A surface of the dielectric substrate 2 is exposed to the grooves.

The patch antenna 5 operates in a main polarization direction (i.e. along the longitudinal direction (x axis direction) of the dielectric substrate 2) which is perpendicular to the arrangement direction of the patch radiating elements 6 to 9 on the dielectric substrate 2. That is, the patch antenna 5 is an antenna capable of satisfactorily receiving a horizontally polarized wave.

An electric power is fed to each of the patch radiating elements 6 to 9 in the patch antenna 5. A structure of feeding electric power to each of the patch radiating elements 6 to 9 is omitted here. Because there are various methods used for feeding electric power to the patch radiating elements 6 to 9 having a patch structure, the explanation of the power supply methods is omitted here. The present exemplary embodiment supplies electric power to each of the patch radiating elements 6 to 9 on the basis of the electro-magnetic coupling type power supply method using microstrip lines which are branched.

The passive conductor sections 11 and 12 are formed between the patch antenna 5 and both edge portions of the dielectric substrate 2 (both edge portions in the main polarization direction). One of them, i.e. the passive conductor section 11, as shown in FIGS. 1(*a*) and (*c*), has a structure in which the two passive elements 21 and 22 having a square patch shape are connected together through a microstrip line 23. Specifically, the passive conductor section 11 is composed of an electric power absorbing passive element 21, a re-radiating passive element 22, and the microstrip line 23. The electric power absorbing passive element 21 and the re-radiating passive element 22 are electrically connected together through the microstrip line 23.

The re-radiating passive element 22 is arranged near the edge portion in the main polarization direction of the dielectric substrate as compared in location with the electric power absorbing passive element 21 (in other words, the re-radiating passive element 22 is arranged at the position more separated from the patch antenna 5). Further, in the direction which is perpendicular to the main polarization direction, the re-radiating passive element 22 and the electric power absorbing passive element 21 are arranged at the positions relatively shifted to each other.

A central portion of the side of the electric power absorbing passive element 21 at the edge portion side of the dielectric substrate is connected to one end of the microstrip line 23. The other end of the microstrip line 23 is connected to a central portion of the upper side (at the upper side in FIG. 1(*a*)) of the re-radiating passive element 22 on the dielectric substrate 2.

As shown in FIGS. 1(*a*) and (*c*), the other passive conductor section 12 is composed of an electric power absorbing passive element 24 having a square shape, a re-radiating passive element 25 having a square shape, and a microstrip line 26. The electric power absorbing passive element 24 and the re-radiating passive element 25 are electrically connected together through the microstrip line 26.

The passive conductor section 12 is arranged so that the passive conductor section 11 and the passive conductor section 12 are arranged symmetrically to each other with respect to the patch antenna 5. That is, the passive conductor section 12 and the passive conductor sections 11 and 12 are arranged laterally reversed along the x axis direction. For this reason, the explanation of the passive conductor section 12 is omitted here.

Each of the patch radiating elements 6 to 9 forming the patch antenna 5 and each of the passive elements 21, 22, 24 and 25 has a square shape, and one side of the square shape has approximately a $\lambda g/2$ in length. The value of $\lambda g$ is a dielectric wavelength, i.e. the wavelength of the dielectric substrate 2. It is possible to express the length of $\lambda g/2$ by using the following equation.

$$\lambda g/2=\lambda 0/\sqrt{\varepsilon r},$$

where $\lambda 0$ is a free space wavelength, $\varepsilon r$ is a dielectric constant of the dielectric substrate 2. The value of $\lambda g/2$ is an example only. The optimal value of $\lambda g/2$ varies due to a shape and size of the base plate, etc. for example.

(2. Function of each of the passive conductor sections 11 and 12) Each of the electric power absorbing passive elements 21 and 24 forming the passive conductor sections 11 and 12, respectively absorbs part of the radio waves (electric power) received by and transmitted from the patch antenna 5. Each of the electric power absorbing passive elements 21 and 24 is formed to resonate at the same frequency of the operating frequency of the patch antenna 5 so that the direction of the main polarized wave component thereof is equal to the direction of the main polarization wave of the patch antenna 5 (that is, the horizontally polarized wave).

It is not always necessary that the resonant frequency of each of the electric power absorbing passive elements 21 and 24 becomes equal to the operating frequency of the patch antenna 5. It is possible to determine the resonant frequency of each of the electric power absorbing passive elements 21 and 24 within a range (a predetermined frequency range containing the operating frequency of the patch antenna 5, for example) capable of moderately absorbing the electric power transmitted from and received by the patch antenna 5. It is preferable for the resonant frequency of each of the electric power absorbing passive elements 21 and 24 to be close to the operating frequency of the patch antenna 5.

The electric power received by the electric power absorbing passive element 21 (24) is transmitted to the re-radiating passive element 22 (25) through the microstrip line 23 (26). The re-radiating passive element 22 (25) radiates the electric power received by the electric power absorbing passive element 21 (24) and transmitted through the microstrip line 23 (26). Each of the re-radiating passive elements 22 and 25 has the main polarized wave component, the direction of which is perpendicular (i.e. the vertically polarized wave) to the main polarization direction of the patch antenna 5, and is formed to resonate at the same frequency of the operating frequency of the patch antenna 5. It is acceptable for each of the re-radiating passive element 22 (25) to have the resonant frequency which is not always equal to the operating frequency of the patch antenna 5, like the resonant frequency of each of the electric power absorbing passive elements 21 and 24.

Each of the passive conductor sections 11 and 12 having the structure previously described has the following function. That is, when the patch antenna 5 operates, each of the electric power absorbing passive elements 21 and 24 is excited by radio waves (an electric field) transmitted from and received by the patch antenna, and each of the electric power absorbing passive elements 21 and 24 absorbs part of the radio waves (electromagnetic energy).

When the patch antenna 5 operates, a surface current flows in the front surface conductive plate 3 and the back surface conductive plate 4 (a large part of the surface current flows on the front surface conductive plate 3), and reaches both the edge portions of the dielectric substrate 2. However, each of the electric power absorbing passive elements 21 and 24 absorbs a part of the electric power of the flow current, it is possible to suppress the flow current from being propagated to both edge portions of the dielectric substrate 2.

On the other hand, it is preferable to consume the electric power absorbed by the each of the electric power absorbing passive elements 21 and 24 by using some methods. In the present exemplary embodiment, each of the re-radiating passive elements 22 and 25, which correspond to the each of the electric power absorbing passive elements 21 and 24, respectively, radiates the absorbed energy as radio wave.

There is a possible influence of reducing the original performance (the directivity on the horizontally polarized wave) of the patch antenna 5 when the re-radiating passive elements 22 and 25 simply radiate the absorbed electric power. Each of the re-radiating passive elements 22 and 25 has an improved structure to radiate the electric power by using a polarized wave (i.e. vertically polarized wave used in the present exemplary embodiment), a direction of which is different from the direction of the main polarization wave (directivity of the horizontally polarized wave). For this reason, no influence is imposed on the patch antenna 5 even if each of the re-radiating passive elements 22 and 25 radiates the electric power.

(3. Directivity and feature of the antenna device 1) In the antenna device 1 according to the present exemplary embodiment, each of the electric power absorbing passive elements 21 and 24 absorbs electric power to suppress the propagation of the surface current to both the edge portions of the dielectric substrate 2. Each of the re-radiating passive elements 22 and 25 radiates the absorbed electric power by using the component of the absorbed electric power having a different polarized surface (i.e. vertically polarized wave) which does not affect the directivity of the main polarized wave (horizontally polarized wave).

Figure 2:
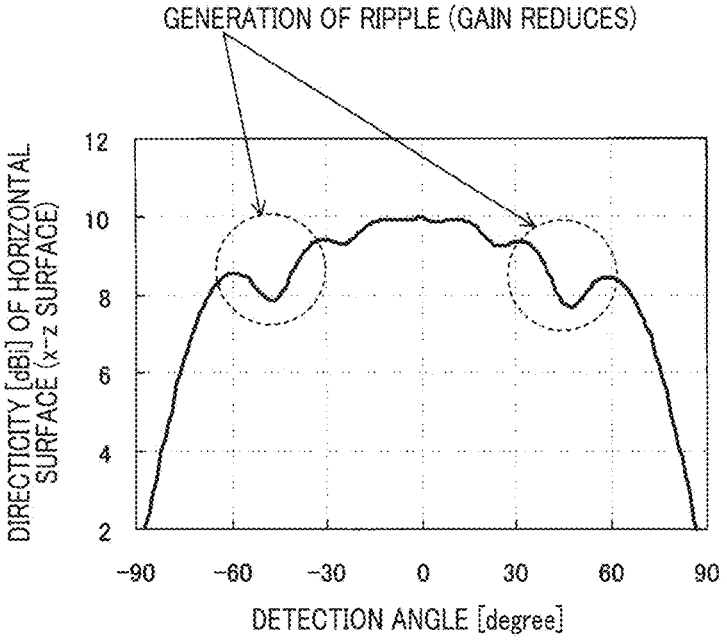
FIGS. 2(*a*) and (*b*) explain a difference in function (in particular, the directivity on a horizontal surface) between the antenna device according to the first exemplary embodiment and a conventional antenna device.
Figure 2:
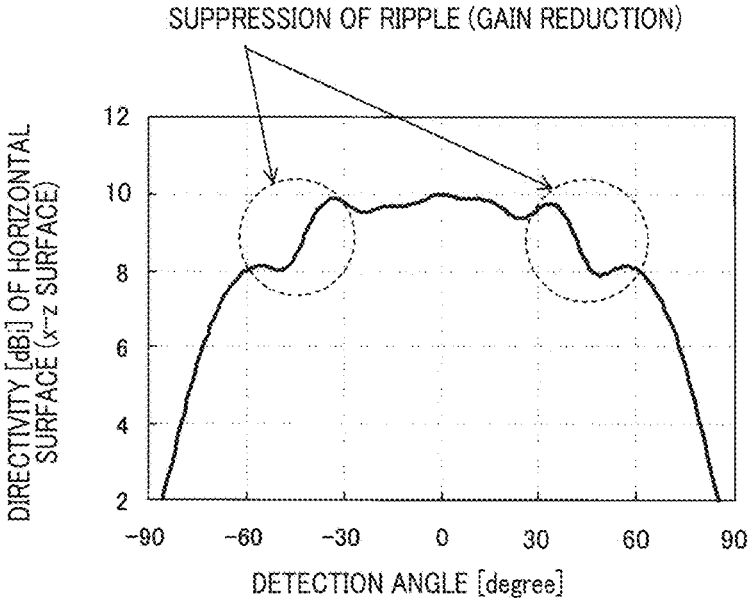

Accordingly, as shown in FIG. 2(*b*), it is possible to suppress reduction of a gain in a predetermined angle range of the directivity on the horizontal surface (xz plane) (i.e. at the surface on which the patch antenna 5 is formed) in front of the antenna device 1 mounted on the vehicle as compared with the conventional structure (without having the passive conductor sections 11 and 12 shown in FIG. 2(*a*).)

That is, a ripple (reduction of a gain) is generated at ±45° to the major axis of transmission of the antenna device having the conventional structure shown in FIG. 2(*a*). The main factor of reducing the gain is a surface current propagated to the edge portions of the dielectric substrate 2, and unnecessary radiation from the edge portions of the base plate.

On the other hand, in the antenna device 1 according to the present exemplary embodiment, each of the passive conductor sections 11 and 12 suppresses the surface current flow. As shown in FIG. 2(*b*), although a small ripple (reduction of a gain) occurs around the point ±50°, the directivity of the antenna device 1 according to the present exemplary embodiment can further suppress the reduction of a gain, as compared with the reduction of a gain in the conventional structure. That is, the antenna device 1 according to the present exemplary embodiment can suppress the disturbance in directivity (in particular, disturbance around ±45° to 50°) as compared with the conventional structure.

(4. Effects, etc. of the first exemplary embodiment) According to the antenna device 1 of the present exemplary embodiment, the passive conductor sections 11 and 12 are formed on the dielectric substrate 2 to absorb part of the radio waves (electric power). This makes it possible to suppress the surface current and the radiation of unnecessary radio wave from the edge portions of the dielectric substrate 2. It is therefore possible to suppress disturbance in directivity of the patch antenna 5 caused by the surface current with a simple structure, and obtain both the suppression of disturbance in directivity and the design flexibility.

In addition, the electric power absorbed by the electric power absorbing passive elements 21 and 24 is transmitted to each of the re-radiating passive elements 22 and 25 through the microstrip lines 23. The re-radiating passive elements 22 and 25 radiate the electric power. This makes it possible to obtain stably the surface current suppression effect (effect of suppressing disturbance in directivity).

Further, each of the re-radiating passive elements 22 and 25 radiates by using a polarized wave which does not affect the main directivity (main polarized wave) of the patch antenna 5. For this reason, it is possible to stably suppress disturbance in directivity.

Still further, each of the electric power absorbing passive elements 21 and 24 and the re-radiating passive elements 22 and 25 resonates with the operating frequency of the patch antenna 5. This makes it possible for each of the electric power absorbing passive elements 21 and 24 to absorb the electric power with high efficiency, and for each of the re-radiating passive elements 22 and 25 to radiate the absorbed electric power with high efficiency. This can suppress the surface current with high efficiency.

Still further, the passive conductor sections are formed at both edge side portions of the dielectric substrate, respectively. This makes it possible to suppress disturbance in directivity in a well-balanced manner, and provide the antenna device 1 having the overall good directivity.

Second Exemplary Embodiment

Figure 3:
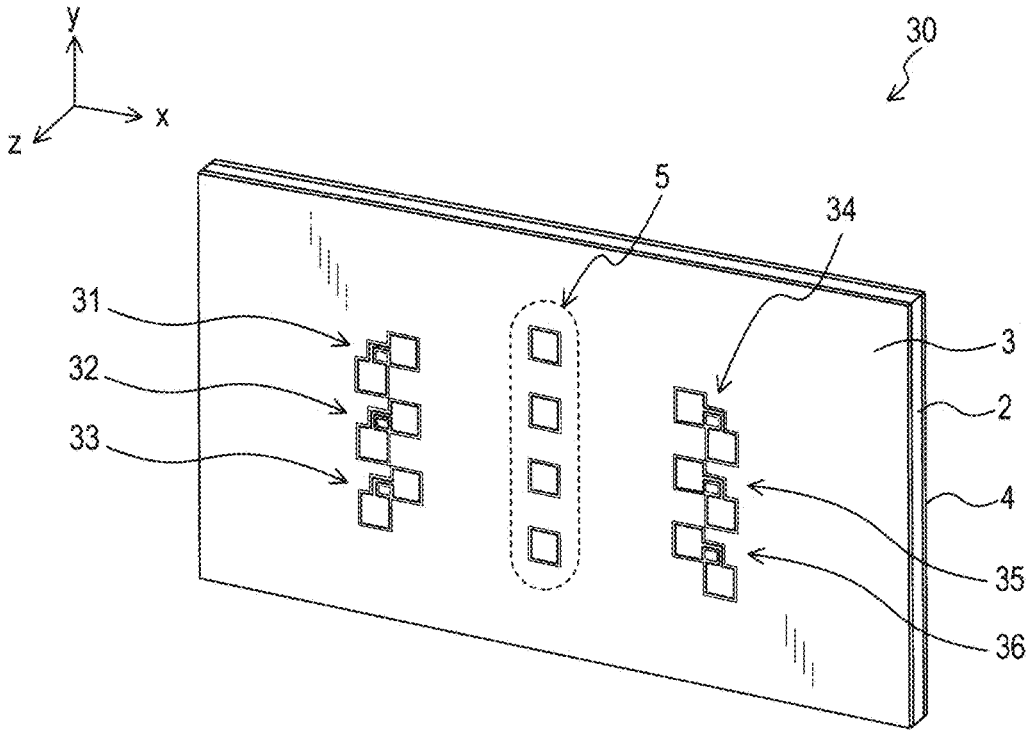
FIG. 3 is a perspective view showing a schematic structure of the antenna device according to a second exemplary embodiment.

The antenna device 30 shown in FIG. 3 has a plurality of passive conductor sections, and the total number of the passive conductor sections is different from that of the antenna device 1 according to the first exemplary embodiment shown in FIGS. 1 (*a*), (*b*) and (*c*). That is, in the antenna device 1 according to the first exemplary embodiment, the passive conductor sections 11 and 12 are formed on both the edge side portions of the patch antenna 5. On the other hand, in the antenna device 30 according to the second exemplary embodiment, three passive conductor sections 31 to 33, 34 to 36 are formed at both the edge side portions of the patch antenna 5, respectively.

Each of the three conductive sections 31, 32 and 33 formed at one edge side portion (at the left side in FIG. 3) of the patch antenna 5 has the same structure of the passive conductive section 11 used in the first exemplary embodiment. These three conductive sections 31, 32 and 33 are arranged in a vertical direction (in the y axis direction).

Each of the three conductive sections 34, 35 and 36 formed at the other edge side portion (at the right side in FIG. 3) of the patch antenna 5 has the same structure of the passive conductive section 12 used in the first exemplary embodiment. These three conductive sections 34, 35 and 36 are also arranged in the vertical direction (in the y axis direction).

That is, it can be understood for the antenna device 30 according to the second exemplary embodiment to have the structure in which the additional passive conductor sections are added at the top and bottom sides of each of the passive conductor sections 11 and 12 in the antenna device 1 according to the first exemplary embodiment.

Each of the electric power absorbing passive elements forming each of the six passive conductor sections 31 to 36 absorbs a part of the electric power, and the corresponding re-radiating passive element 22 radiates the absorbed electric power.

Figure 4:
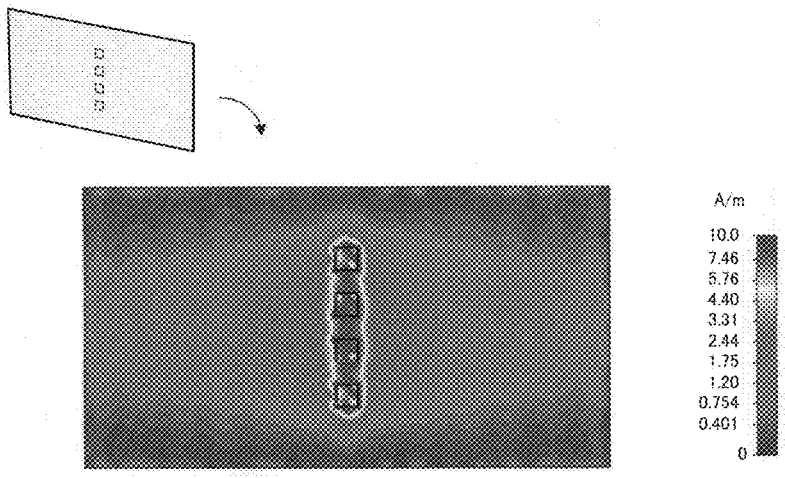
FIGS. 4(*a*) and (*b*) explain a difference in function (in particular, distribution of a surface current) between the antenna device according to the second exemplary embodiment and the conventional antenna device.
Figure 4:
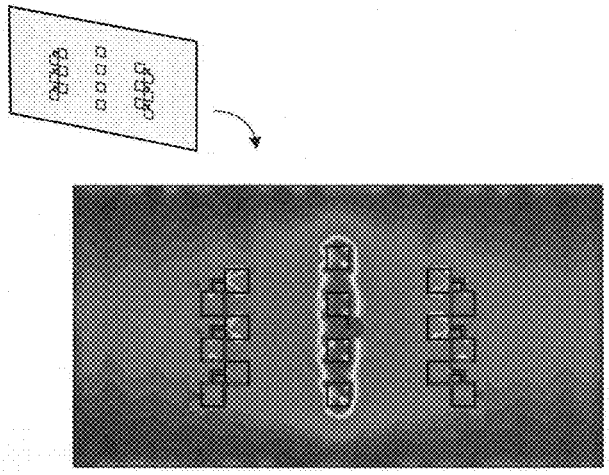

For this reason, as shown in FIG. 4(*b*), a current distribution of the surface current flowing on the surface of the antenna device 30 can suppress the flow of the surface current to both the edge portions of the dielectric substrate 2 as compared with the conventional structure (without having the passive conductor sections 31 to 36) shown in FIG. 4(*a*). That is, a weak surface current flows to the edge portions of the dielectric substrate in the antenna device 30 as compared with that of the conventional structure. In the antenna device 1 according to the first exemplary embodiment shown in FIGS. 1(*a*), (*b*) and (*c*) also has the same current distribution shown in FIG. 4(*b*), and can suppress accordingly the propagation of the surface current to the edge portions of the dielectric substrate as compared with that of the conventional structure.

As previously described, because it is possible to suppress the propagation of a surface current to both edge portions of the dielectric substrate, the ripple (reduction of a gain) can be drastically suppressed around ±45° in the horizontal directivity of the horizontally polarized wave component in the antenna device 30, as compared with the conventional structure without having the passive conductive sections 31 to 36.

Figure 5:
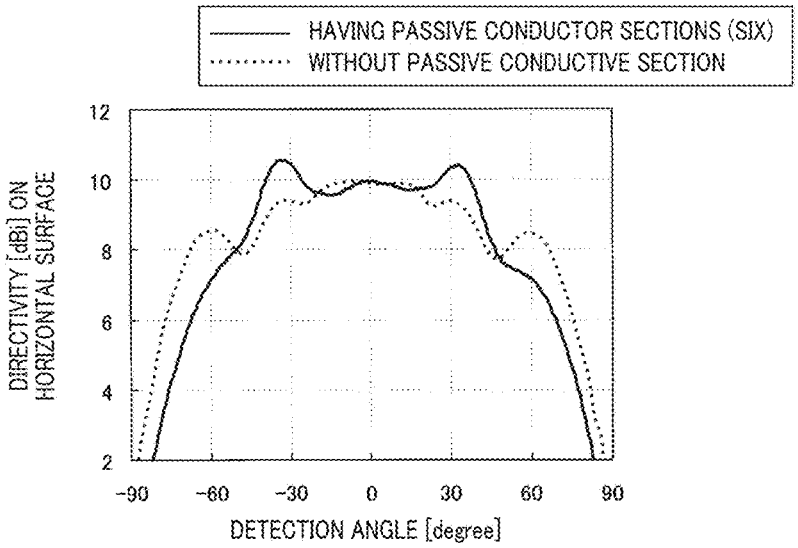
FIGS. 5(*a*) and (*b*) show a directivity of the antenna device according to the second exemplary embodiment.
Figure 5:
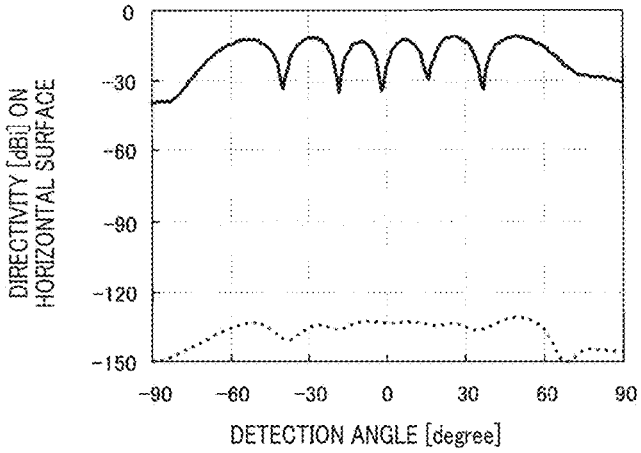

On the other hand, the electric power absorbed by each of the passive conductive sections 31 to 36 is radiated as a vertically polarized radio wave. For this reason, as shown in FIG. 5(*b*), the horizontal directivity of the vertically polarized wave component of the antenna device 30 has a gain higher than that of the conventional structure without having the passive conductive sections 31 to 36. The reradiated radio wave is a vertically polarized wave which is polarized perpendicular to the main polarized wave (i.e. the main polarized wave of the antenna device 30) of the patch antenna 5, and does not therefore affect any directivity of the main polarized wave of the patch antenna 5. For this reason, on an actual use of the antenna device 30, the radiated component of the vertically polarized wave radiated from each of the passive conductive sections 31 to 36 does not have any influence on the main polarized wave.

Accordingly, it is possible for the antenna device 30 according to the second exemplary embodiment to have the same effect of the antenna device 1 according to the first exemplary embodiment. In particular, because the antenna device 30 according to the present exemplary embodiment has a plurality of the passive conductive sections (three passive conductive sections in the present exemplary embodiment) at both ends of the patch antenna 5, this makes it possible to obtain a highly suppression effect of preventing a surface current.

Third Exemplary Embodiment

Figure 6:
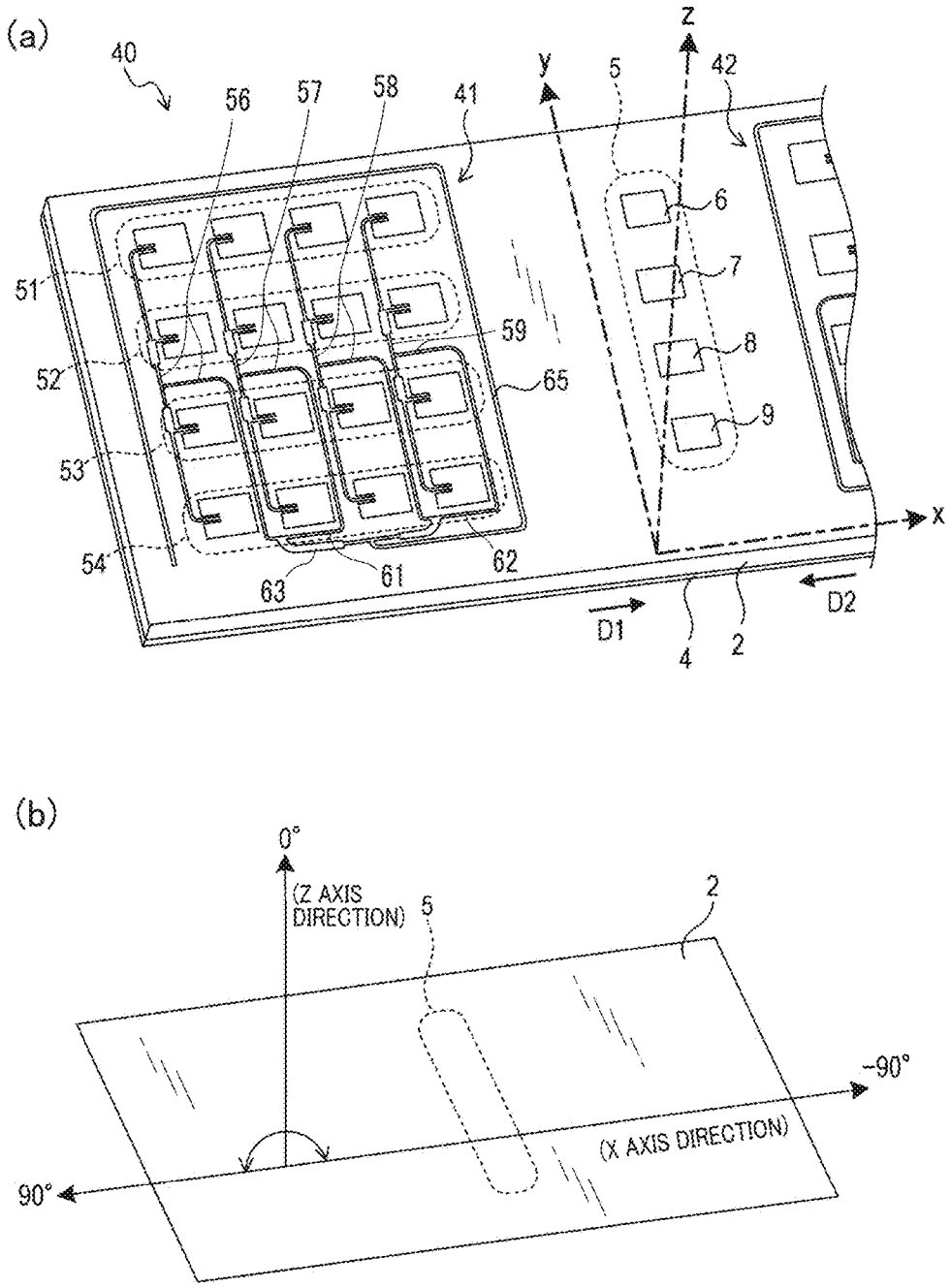
FIGS. 6(*a*) and (*b*) show a schematic structure of the antenna device according to a third exemplary embodiment.

The antenna device 40 according to the third exemplary embodiment shown in FIGS. 6(*a*) and (*b*) has a structure in which the patch antenna 5 is formed on the surface of the dielectric substrate 2 on which the conductive plate (the back surface conductor plate) 4 which acts as the base plate is formed. The dielectric substrate 2 has the same size and shape of the dielectric substrate 2 in the antenna device 1 according to the first exemplary embodiment. The patch antenna 5 has the same structure and arrangement in the dielectric substrate 2 of the antenna device 1 according to the first exemplary embodiment.

In particular, the conductive plate as the base plate is not formed on the front surface of the dielectric substrate 2. Passive element arrays 41 and 42 shown in FIG. 6(*a*) are arranged on both edge side portions of the patch antenna 5 on the front surface of the dielectric substrate 2, which is not the passive conductor sections 11 and 12 used in the first exemplary embodiment.

Each of the passive element arrays 41 and 42 has a plurality of passive elements (the number thereof in the third exemplary embodiment is 16) having a square shape. Each of the passive elements is composed of a patch-shaped conductor, and acts as the same function of the electric power absorbing passive elements in the antenna device 1 according to the first exemplary embodiment. That is, a plurality of the passive elements in each of the passive element arrays 41 and 42 has the function of suppressing propagation of a surface wave to the edge portions of the dielectric substrate by absorbing part of the surface waves (surface current) flowing on the surface of the dielectric substrate. Further, each of the passive elements excites in the same direction and has the same frequency of the electric power absorbing passive elements used in the first exemplary embodiment.

In viewed from each of the passive element arrays 41 and 42, a direction parallel to the x axis at the patch antenna 5 side is called the "main antenna direction". That is, the main antenna direction, in viewed from the passive element array 41 at the left side on FIG. 6(*a*), is designated by the arrow D1. The main antenna direction, in viewed from the passive element array 42 at the right side on FIG. 6(*a*), is designated by the arrow D2.

As shown in FIG. 6(*b*), an azimuth (detection angle) on the horizontal surface (surface E) is defined so that the left side viewed from the vehicle to the antenna device 40 is a negative angle and the right side viewed from the vehicle to the antenna device 40 is a positive angle. Accordingly, the main antenna direction D1 viewed from the passive element array 41 at the left side on FIG. 6(*b*) is a direction of −90° in the detection angle on the horizontal surface. The main antenna direction D2 viewed from the passive element array 42 at the right side on FIG. 6(*b*) is a direction of 90° in the detection angle on the horizontal surface.

Each of the passive element arrays 41 and 42 is arranged symmetrically in right and left around the patch antenna 5. Each of the passive element arrays 41 and 42 has the same structure and functions to each other. Accordingly, the passive element array 41 at the left side shown in FIG. 6(*a*) will be explained in detail, and the explanation of the passive element array 42 is omitted for brevity.

As shown in FIG. 6(*a*), the four arrays 51, 52, 53 and 54 are arranged at predetermined interval in the y axis direction in the passive element array 41. Each of the first array 51, the second array 52, the third array 53 and the fourth array 54 has four passive elements arranged in the x axis direction. A description will now be given of the detailed explanation of the passive element array 41 with reference to FIG. 7.

Figure 7:
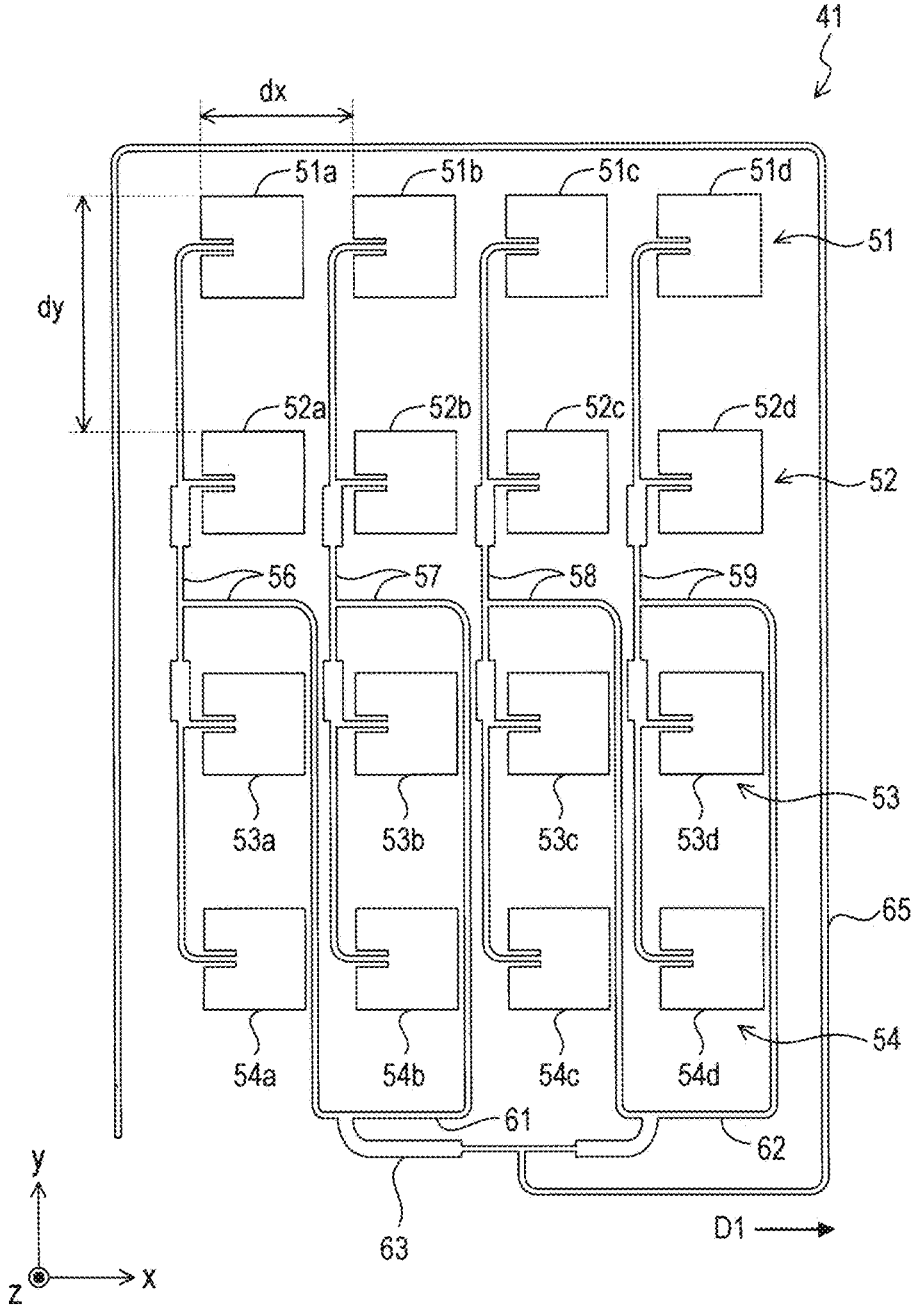
FIG. 7 is a view showing a detailed structure of a passive element array.

As shown in FIG. 7, the first array 51 has a first passive element 51*a*, a second passive element 51*b*, a third passive element 51*c* and a fourth passive element 51*d*. Those four passive elements 51*a* to 51*d* have the same shape (approximately, a square shape), and arranged in an array shape along the x axis direction at a predetermined element arrangement interval dx.

The other three arrays 52, 53 and 54 have the same structure of the first array 51. That is, the second array 52 has the four passive elements 52*a* to 52*d* arranged at the predetermined element arrangement interval dx along the x axis direction. The third array 53 has the four passive elements 53*a* to 53*d* arranged at the predetermined element arrangement interval dx along the x axis direction. Similarly, the fourth array 54 has the four passive elements 54*a* to 54*d* arranged at the predetermined element arrangement interval dx along the x axis direction.

The four arrays 51 to 54 are arranged at the same location along the x axis direction, and at a predetermined array arrangement interval dy along the y axis direction. The overall 16 passive elements in the arrays 51 to 54, as previously explained, acts as the electric power absorbing elements. That is, those elements absorb a surface wave propagated on the surface of the dielectric substrate when the patch antenna 5 receives and transmits radio waves.

Each of the first passive elements 51*a*, 52*a*, 53*a* and 54*a* in the four passive elements of the arrays 51 to 54, which are farthest apart from the patch antenna 5 (at the farthest edge portion of the dielectric substrate) is connected to a first transmission line 56. The first transmission line 56 is connected approximately the central section of the side in the two sides of each of the first passive elements 51*a*, 52*a*, 53*a* and 54*a* at the opposite to the patch antenna 5 side.

A cut part is formed at a central part of the side, to which the first transmission line 56 is connected, in the passive element. The first transmission line 56 is inserted into the cut part of the side of the passive element so that they are connected to each other. Through the cut part of the passive element, the first transmission line 56 and the first passive element are matched to each other. Accordingly, it is not necessary to form such a cut part in the first passive element. It is also possible to use another connection structure in order to connect the first transmission line 56 with the first passive elements to each other.

Similarly, each of the second passive elements 51*b*, 52*b*, 53*b* and 54*b* in the four passive elements of the arrays 51 to 54 is connected to a second transmission line 57. Each of the third passive elements 51*c*, 52*c*, 53*c* and 54*c* in the four passive elements of the arrays 51 to 54 is connected to a third transmission line 58. Similarly, each of the fourth passive elements 51*d*, 52*d*, 53*d* and 54*d* in the four passive elements of the arrays 51 to 54 is connected to a fourth transmission line 59. Each of the transmission lines 56 to 59 is made of a microstrip line.

The first transmission line 56 and the second transmission line 57 are connected together through a first sub-connection line 61. The first sub-connection line 61 has approximately a straight shape formed along the x axis direction. One end of the first sub-connection line 61 is connected to a lower end of the first transmission line 56, and the other end of the first sub-connection line 61 is connected to the lower end of the second transmission line 57.

The third transmission line 58 and the fourth transmission line 59 are connected together through a second sub-connection line 62. The second sub-connection line 62 has approximately a straight shape formed along the x axis direction. One end of the second sub-connection line 62 is connected to a lower end of the third transmission line 58, and the other end of the second sub-connection line 62 is connected to the lower end of the fourth transmission line 59. The first sub-connection line 61 and the second sub-connection line 62 have the same shape and size.

The two second sub-connection lines 61 and 62 are connected to each other by a main connection line 63. The main connection line 63 is a microstrip line having approximately a straight shape formed along the x axis direction. One end of the main connection line 63 is connected to a predetermined connection node of the first sub-connection line 61, and the other end thereof is connected to a predetermined node of the second sub-connection line 62.

The connection node of the first sub-connection line 61, at which the main connection line 63 is connected to the first sub-connection line 61, is not a central position in the x axis direction of the first sub-connection line 61 and shifted (offset) apart from the central position by a predetermined distance to the edge portion of the dielectric substrate. Similarly, the connection node of the second sub-connection line 62, at which the main connection line 63 is connected to the second sub-connection line 62, is not a central position in the x axis direction of the second sub-connection line 62 and offset to be apart from the central position by a predetermined distance to the edge portion of the dielectric substrate.

An electric power consuming transmission line 65 is connected to a predetermined connection point of the main connection line 63. As shown in FIG. 7, the electric power consuming transmission line 65 is a microstrip line having a length long enough to be arranged counterclockwise to surround all of the 16 passive elements.

The main connection line 63 and the electric power consuming transmission line 65 are connected together at a connection node which is offset (at the patch antenna 5 side) opposite to the edge portion of the dielectric substrate by a predetermined distance from the intermediate point along the x axis direction of the main connection line 63.

The electric power consuming transmission line 65 has the same function of the re-radiating passive element used in the antenna device 1 according to the first exemplary embodiment. That is, the surface waver energy absorbed by each of the first passive elements 51*a*, 52*a*, 53*a* and 54*a* is transmitted to the connection node (hereinafter, also called the re-outputting position") between the electric power consuming transmission line 65 and the main connection line 63 through the first transmission line 56 and the first sub-connection line 61. The surface waver energy absorbed by each of the second passive elements 51*b*, 52*b*, 53*b* and 54*b* is transmitted to the connection node between the electric power consuming transmission line 65 and the main connection line 63 through the second transmission line 57 and the first sub-connection line 61. The surface waver energy absorbed by each of the third passive elements 51*c*, 52*c*, 53*c* and 54*c* is transmitted to the connection node between the electric power consuming transmission line 65 and the main connection line 63 through the third transmission line 58 and the second sub-connection line 62. The surface waver energy absorbed by each of the fourth passive elements 51*d*, 52*d*, 53*d* and 54*d* is transmitted to the connection node between the electric power consuming transmission line 65 and the main connection line 63 through the fourth transmission line 58 and the second sub-connection line 62.

The electric power consuming transmission line 65 is arranged to consume the transmitted surface wave energy. The surface wave energy absorbed by each of the passive elements is discharged to the electric power consuming transmission line 65, and consumed (a large part thereof is converted to heat energy) while being transmitted to the edge portion of the electric power consuming transmission line 65.

In order to consume the surface wave energy with high efficiency, it is preferable for the electric power consuming transmission line 65 to have a long length. Specifically, it is preferable for the electric power consuming transmission line 65 to have a length which is not less than ten times of the dielectric wavelength λg. FIG. 6(*a*) and FIG. 7 show the electric power consuming transmission line 65 approximately being 15 λg long.

The four passive elements 51*a*, 51*b*, 51*c* and 51*d* forming the first array 51 are arranged so that the main antenna direction D1 has a maximal sensitivity. That is, the first array 51 is designed to have a structure in which the first array 51 has the sensitivity (directivity) in the main antenna direction D1. The sensitivity (directivity) of each of the arrays 51 to 54 indicates an absorbing efficiency of the surface wave. The high sensitivity of the array indicates to have a highly absorbing efficiency. The sensitivity of each of the arrays 51 to 54 is also called the "array factor".

In order for the first array 51 to enhance the surface wave absorbing effect, it is preferable to have the maximum sensitivity in the main antenna direction D1. In order to achieve this, the first array 51 has a structure to have the maximum sensitivity in the main antenna direction D1.

In order for the first array 51 to have a maximum sensitivity (maximum absorbing efficiency) to the surface wave, it is sufficient to satisfy the following equation (1).

$$\varphi n = 2\cdot\pi\cdot dx\cdot(n-1)\cdot\sin\theta/\lambda 0 \quad (1),$$

where dx indicates an element arrangement interval, and φn indicates a feeding phase of each of the passive elements.

The equation (1) satisfies a relationship of $dx<\lambda 0/2$, n is an arrangement order (n=1, 2, 3, 4) of the passive elements from the edge portion of the dielectric substrate toward the main antenna direction D1, λ0 indicates a free space wavelength, and θ is a difference in angle between the z axis direction and the main antenna direction D1 viewed from the passive elements. The present exemplary embodiment uses the angle difference θ=90°.

When the equation (1) is satisfied, the first array 51 has a concentrated sensitivity in the main antenna direction D1. On the other hand, the first array 51 has a low sensitivity in an opposite direction (a substrate edge direction) to the main antenna direction D1. Accordingly, the first array 51 used in the present exemplary embodiment has the structure to satisfy the equation (1).

That is, the feeding phase φ1 of the first passive element 51*a* (n=1) located mostly close to the edge portion of the dielectric substrate in the four passive elements 51*a*, 51*b*, 51*c* and 51*d* has the value φ1=0. The feeding phase φ2 of the second passive element 51*b* (n=2) located next to the first passive element 51*a* in (the main antenna direction D1 side) has the value $\varphi 2=2\cdot\pi\cdot dx/\lambda 0$. The feeding phase φ3 of the third passive element 51*c* (n=3) located next to the second passive element 51*c* in (the main antenna direction D1 side) has the value $\varphi 3=4\cdot\pi\cdot dx/\lambda 0$. The feeding phase φ4 of the fourth passive element 51*d* (n=4) located next to the third passive element 51*c* in (the main antenna direction D1 side) has the value $\varphi 4=6\cdot\pi\cdot dx/\lambda 0$. For example, when dx=0.4 λ0, the feeding phases φ1 to φ4 become φ1=0°, φ2=about 144°, φ3=about 288°, and φ4=about 432°, respectively.

As previously described, it is possible to have the optimal array factor on the horizontal surface (surface E) of the first array 51 by using each of the feeding phase φ1 to the feeding phase φ4 to satisfy the equation (1) on the basis of the optimally-determined element arrangement interval dx.

There are various methods of having a different feeding phase of each of the passive elements 51*a* to 51*d*. The present exemplary embodiment forms the passive elements 51*a* to 51*d* having a different feeding phase by using a different length of the transmission line from each of the passive elements 51*a* to 51*d* to the start edge portion (at the re-outputting point of the main connection line 63) of the electric power consuming transmission line 65. As previously described, the connection node between the main connection line 63 and each of the sub-connection lines 61 and 62 is offset from the central position of each of the sub-connection lines 61 and 62. Furthermore, the connection node between the main connection line 63 and the electric power consuming transmission line 65 is offset from the main connection line 63. The offset of each of the connection nodes makes it possible to obtain each of the feeding phase φ1 to the feeding phase φ4.

To adjust the offset previously described makes it possible to have a desired feeding phase of each of the passive elements 51*a* to 51*d* with relative ease. For this reason, it is possible to increase the design flexibility of the element arrangement interval dx by using the offset adjustment to adjust the feeding phase previously described.

Because the other three passive element arrays 52, 53 and 54 have the same structure of the passive element array 51 excepting the different arrangement in the y axial direction, the detailed explanation of the three arrays 52, 53 and 54 is omitted here.

It is preferable to have the element arrangement interval dx which is shorter than at least ½ times of the free space wavelength λ0. The reason why is as follows. When the element arrangement interval dx has a length of not less than the ½ times of the free space wavelength λ0, the grading becomes large in the direction opposite to the main antenna direction D1, and as a result, the overall array factor in the main antenna direction decreases.

Figure 8:
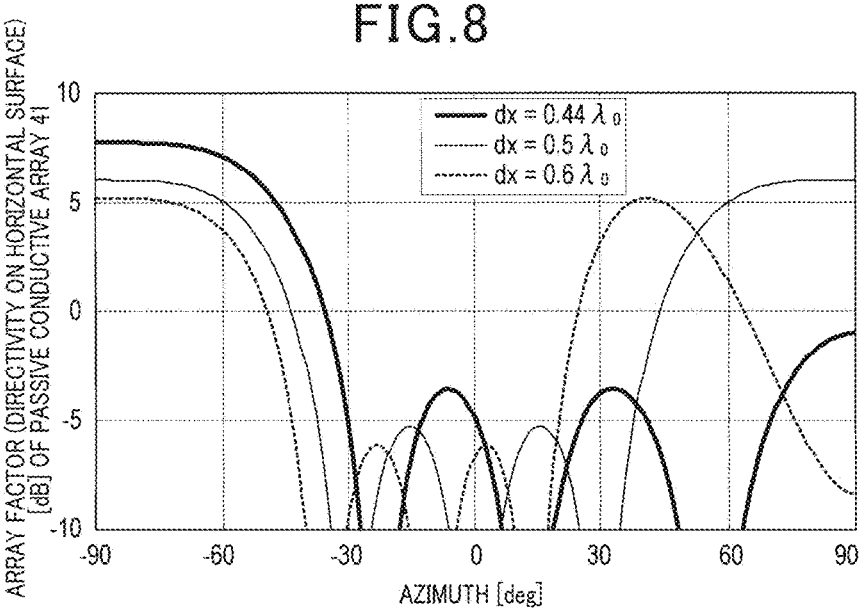
FIG. 8 is a view explaining a relationship between an element arrangement interval dx and the directivity on the horizontal surface of the passive element array.

FIG. 8 shows one example of the array factor (horizontal surface directivity) of the passive element array 41 when the element arrangement interval dx is 0.44 λ0, 0.5 λ0, and 0.6 λ0. As can be clearly understood from FIG. 8, the directivity of the main antenna direction D1 (azimuth angle: −90°) has the maximum value when the element arrangement interval dx is 0.44 λ0. This makes it possible to mostly suppress the grating in the direction opposite to the main antenna direction D1.

On the other hand, the array factor of the passive element array decreases and the grating increases when the element arrangement interval dx is 0.5λ0. Further, the array factor in the main antenna direction D1 further decreases, and the grating is maintained to have a large value when the element arrangement interval dx is 0.6λ0. Accordingly, it is preferable for the element arrangement interval dx to have a length which is at least less than a half of the free space wavelength λ0 in order to suppress the grating as low as possible, and increase the array factor in the main antenna direction D1 as high as possible.

In order to obtain the predetermined array factor, it is possible to use another method of increasing the number of passive elements to be arranged in addition to the method of determining the optimal element arrangement interval dx. That is, the present exemplary embodiment has the structure in which the first array 51 consists of the four passive elements 51*a* to 51*d*. It is also possible for the first array 51 to have a structure of increasing the number of the passive elements along the x axis direction in order to increase the array factor in the main antenna direction D1 and reduce its beam width. That is, the more the number of the passive element arranged in the array shape increases, the higher the intensity of the beam in the main antenna direction D1 is.

Figure 9:
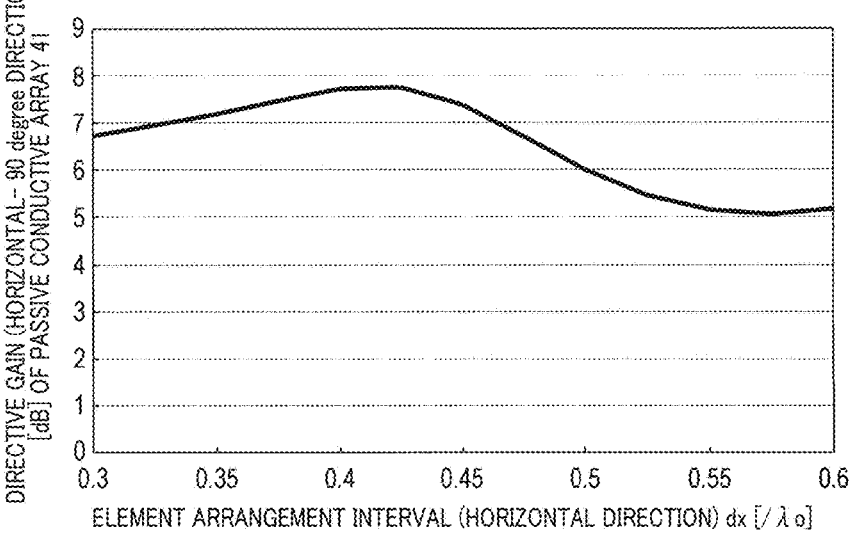
FIG. 9 is a view explaining a relationship between the element arrangement interval dx and a directive gain in horizontal-90° direction (direction to a main antenna) of the passive element array.

For example, FIG. 9 shows the directive gain in the horizontal direction of −90° (i.e. in the main antenna direction D1) of the passive element array 41 when the element arrangement interval dx is changed from 0.3 λ0 to 0.6 λ0. In the case shown in FIG. 9, the sensitivity in the main antenna direction D1 has the maximum value when the element arrangement interval dx is approximately 0.42λ0.

Figure 10:
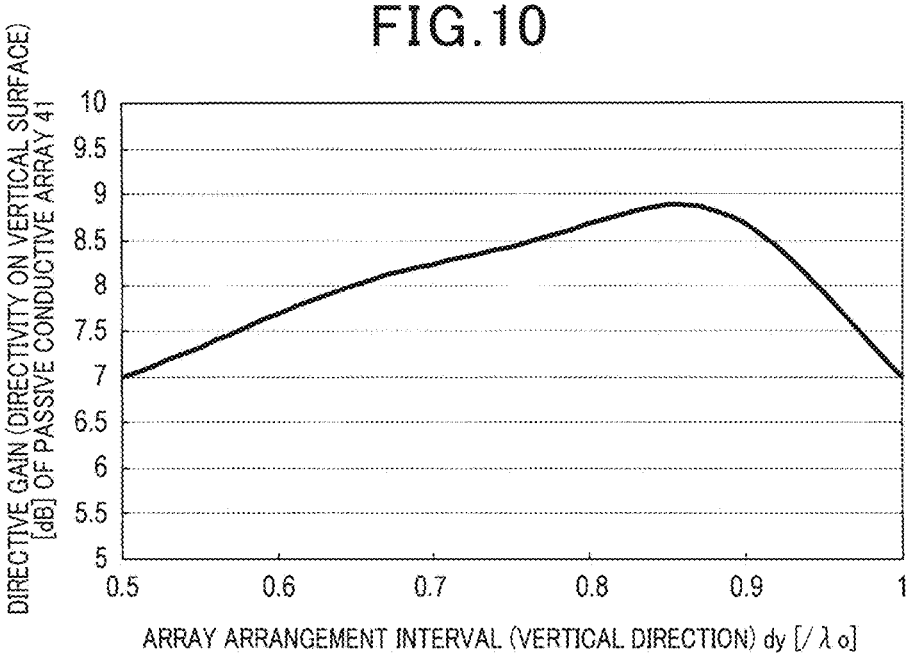
FIG. 10 is a view explaining a relationship between an array arrangement interval dy and a directive gain in vertical-front surface direction of the passive element array.

On the other hand, the directive gain in the vertically front surface direction (central direction in the vertical surface) of the passive element array 41 varies by the distance in position between the arrays 51 to 54, i.e. the array arrangement interval dy in the y axis direction. For example, FIG. 10 shows the directive gain in the vertically front surface direction of the passive element array 41 when the array arrangement interval dy is changed from 0.5λ0 to λ0. In the example shown in FIG. 10, the directive gain in the vertically front surface direction of the passive element array 41 has a maximum value when the array arrangement interval dy is approximately 0.86λ0.

Figure 11:
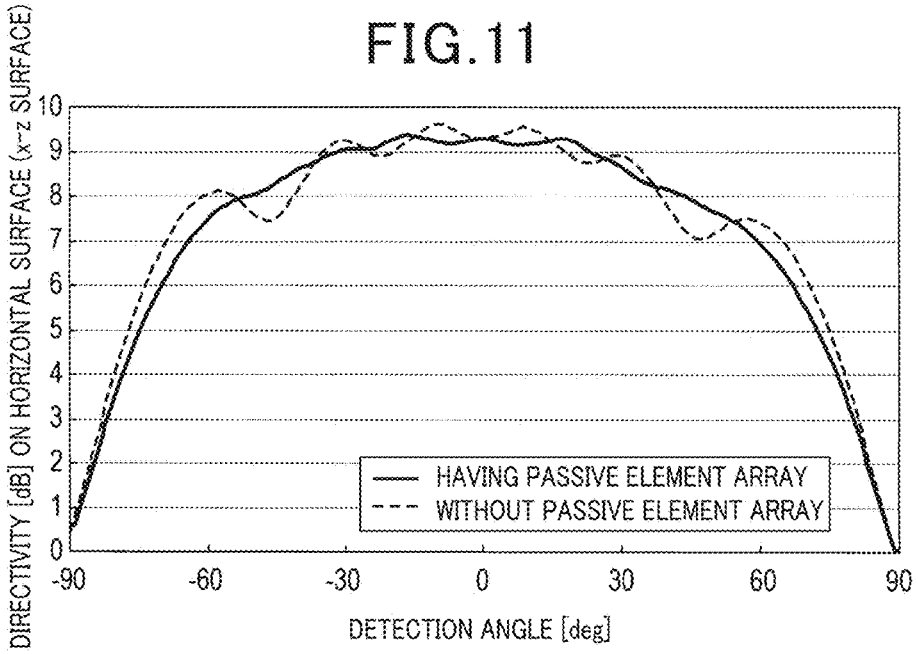
FIG. 11 is a view explaining a horizontal surface directivity of the antenna device according to the third exemplary embodiment.

FIG. 11 shows the horizontal surface directivity of the antenna device 40 having the two passive element arrays 41 and 42 according to the present exemplary embodiment. FIG. 11 shows the directivity (designated by the solid wave line) of the antenna device 40 equipped with the two passive element arrays 41 and 42, and the directivity of an antenna device as a comparative example having the patch antenna 5 only without having the passive element array.

As can be clearly understood from FIG. 11, the directivity of the antenna device without having the passive element array has a large ripple around the angles ±45°. On the other hand, the antenna device 40 equipped with the passive element arrays 41 and 42 according to the present exemplary embodiment drastically suppresses the ripple around ±45° and fluctuation of the overall directivity, i.e. has a stable directivity.

As previously explained, the antenna device 40 according to the third exemplary embodiment has the passive element arrays 41 and 42 formed at both ends of the patch antenna 5. Each of the passive element arrays 41 and 42 absorbs the surface wave energy propagated on the dielectric substrate, and suppresses unnecessary radiation from the edge portions of the dielectric substrate. It is thereby possible to suppress fluctuation of the directivity and increase the design flexibility.

In particular, in the structure of the third exemplary embodiment, a plurality of the passive elements is arranged in an array shape. This makes it possible to more absorb the energy of surface waves with high efficiency. Further, the passive elements formed in the array shape along the x axis direction are connected to each other and further connected to the electric power consuming transmission line 65. This structure makes it possible for the electric power consuming transmission line 65 to consume the overall surface wave energy by the electric power. Furthermore, it is formed so that the arrangement interval (the array arrangement interval dx) of the passive elements in the x axis direction and the feeding phase of each of the passive elements satisfy the equation (1) previously described. This structure makes it possible to absorb and consume the surface wave energy with high efficiency with a simple structure.

It is possible to use another method of consuming the surface wave energy absorbed by each of the arrays 51 to 54 instead of using the method using the electric power consuming transmission line 65 to perform heat energy consumption shown in FIG. 6(*a*), (*b*) and FIG. 7.

Figure 12:
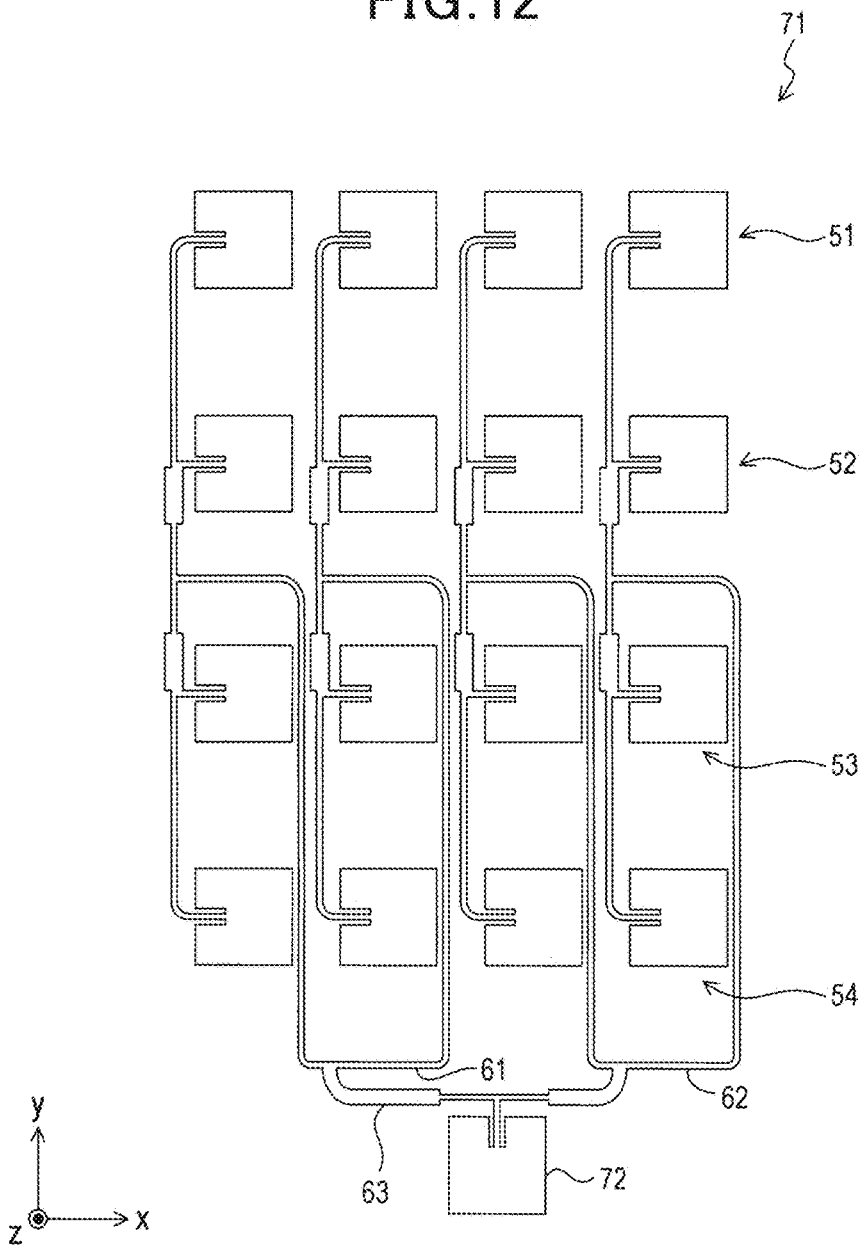
FIG. 12 is a view showing a structure of the passive element array according to another exemplary embodiment.

For example, it is possible to consume (re-radiating) the surface wave energy by using a re-radiating passive element 72 in a passive element array 71 shown in FIG. 12. In the passive element array 71 shown in FIG. 12, the re-radiating passive element 72 is connected to a re-outputting position of the main connection line 63. This re-radiating passive element 72 has the same function of the re-radiating passive elements 22 and 25 used in the first exemplary embodiment. That is, the re-radiating passive element 72 excites in the same direction in a case of the re-radiating passive element 22 and 25 according to the first exemplary embodiment, and has the same resonant frequency of the re-radiating passive elements 22 and 25, and radiates the electric power (surface wave energy) absorbed by each of the arrays 51 to 54.

The re-radiating passive element 72 has the main polarization direction which is perpendicular to the main polarization direction (horizontal direction) of the patch antenna 5. Accordingly, there is no actual influence to the performance of the patch antenna 5 caused by the radiation from the re-radiating passive element 72.

Figure 13:
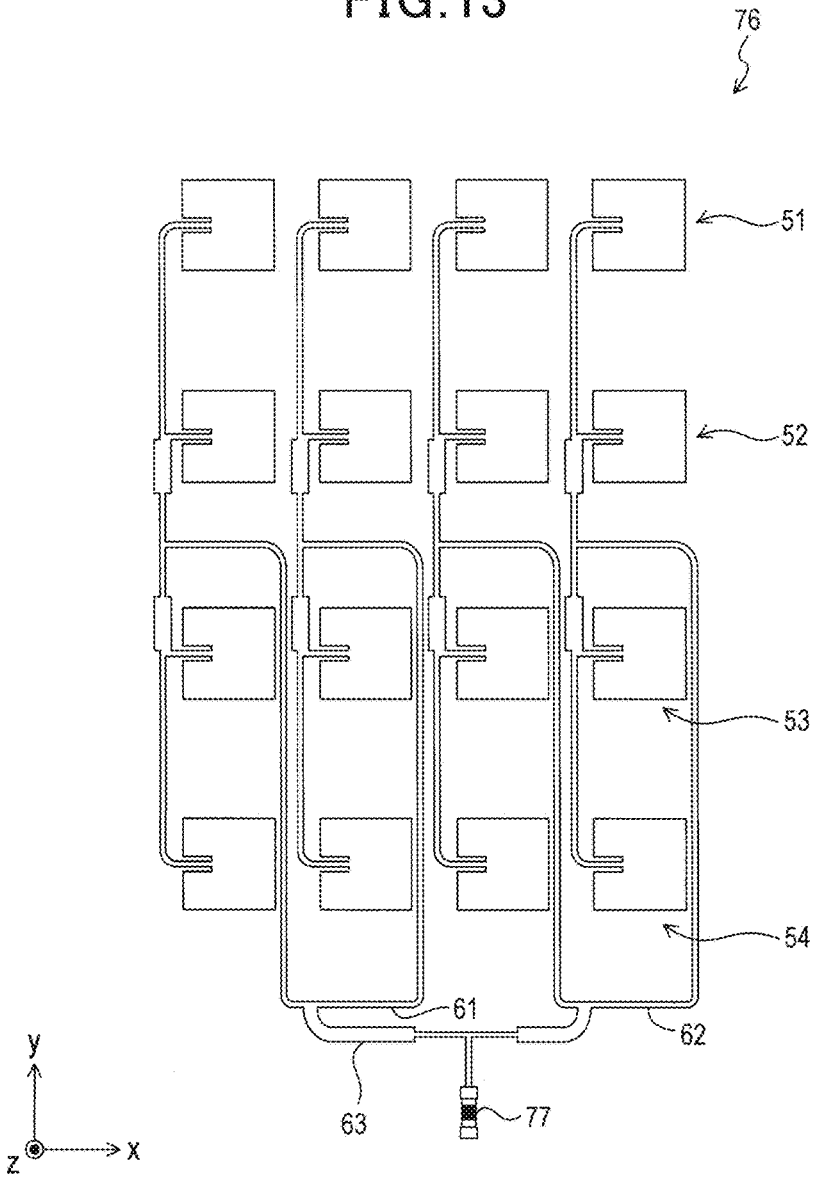
FIG. 13 is a view showing a structure of the passive element array according to the other exemplary embodiment.

Further, it is acceptable to perform the heat consumption by using a terminal resistor 77 (a chip resistor used by the present exemplary embodiment) in a passive element array 76 shown in FIG. 13. In the passive element array 76 shown in FIG. 13, a re-outputting position of the main connection line 63 is connected to one end of the chip resistor 77. The other end of the chip resistor 77 is connected to the back surface conductor plate 4 through a conductive via, etc. for example. The chip resistor 77 is used as a surface mount member without a lead line, i.e. a known small-sized resistor (resistance element).

When the surface wave energy absorbed by each of the arrays 51 to 54 is transmitted to the chip resistor 77, a current flows to the back surface conductor plate 4 through the chip resistor 77. The chip resistor 77 generates heat energy and the surface wave energy absorbed by each of the arrays 51 to 54 is consumed when the current flows in the chip resistor 77.

Other Exemplary Embodiments (1) It is possible to use various shapes of the passive conductor sections instead of using the shape of the passive conductor sections 11, 12 shown in FIGS. 1(*a*), (*b*) and (*c*).

Figure 14:
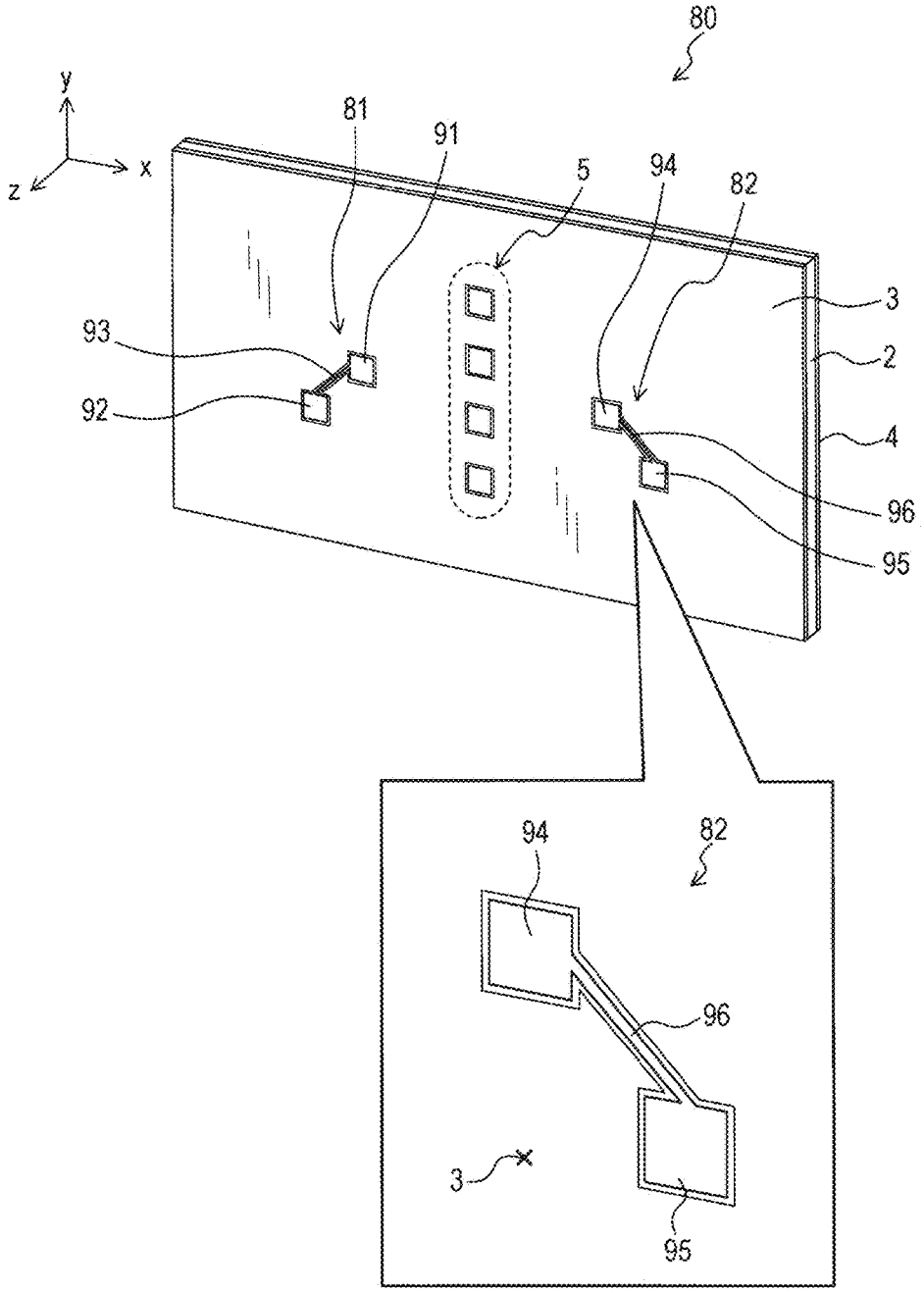
FIG. 14 is a perspective view showing the antenna device according to another exemplary embodiment.

For example, it is possible to connect the electric power absorbing passive element with the re-radiating passive element by using a microstrip line in an antenna device 80 shown in FIG. 14. Each of the passive conductor sections 81 and 82 has a different shape (in particular, a shape of each of the microstrip lines 93 and 96), as compared with the structure of the antenna device 1 according to the first exemplary embodiment shown in FIGS. 1(*a*), (*b*) and (*c*).

In the passive conductor section 81, an electric power absorbing passive element 91 is connected to a re-radiating passive element 92 through a microstrip line 93 having a straight line shape. Each of the electric power absorbing passive element 91 and the re-radiating passive element 92 is connected to the microstrip line 93 at the same connection node used in the first exemplary embodiment. Similarly, in the other passive conductor section 82, an electric power absorbing passive element 94 is connected to a re-radiating passive element 95 through a microstrip line 96 having a straight line shape.

It is possible for the antenna device 80 shown in FIG. 14 having the structure previously described to have the same action and effects of the antenna device 1 according to the first exemplary embodiment. (2) In the passive conductor section disclosed by the first and second exemplary embodiments previously described, electric power absorbed by the electric power absorbing passive elements is radiated to space by the re-radiating passive elements to consume the electric power. However, the concept of the present invention is not limited by this. It is possible to consume the absorbed electric power by using another method.

It can be considered to perform the heat consumption in order to consume the absorbed electric power, as shown in the third exemplary embodiment shown in FIGS. 6(*a*) and (*b*). More specifically, it is possible for the resistance element to generate Joule heat in order to consume the electric power absorbed by the electric power absorbing passive elements. An antenna device 100 shown in FIGS. 15(*a*) and (*b*) has a structure capable of generating heat energy in order to consume electric power absorbed by the electric power absorbing passive elements.

Figure 15:
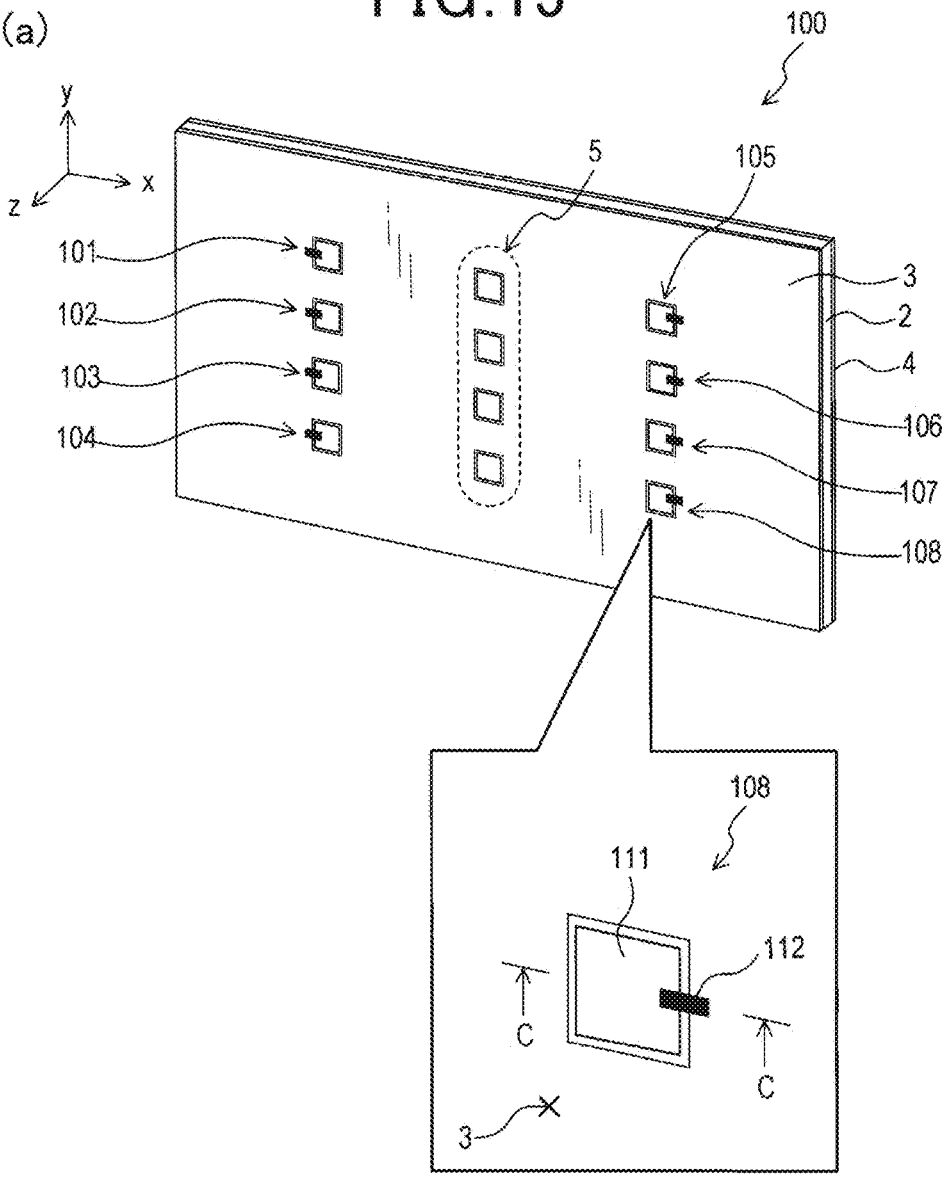
FIGS. 15(*a*) and (*b*) are perspective views showing the antenna device according to the other exemplary embodiments.
Figure 15:
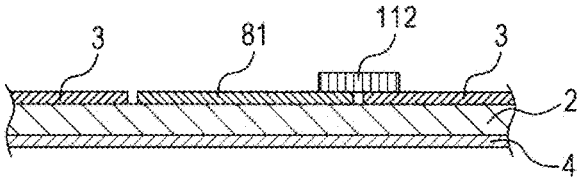

That is, the antenna device 100 shown in FIGS. 15(*a*) and (*b*) has the passive conductor sections which is different in structure and the total number thereof from those in the antenna device 1 according to the first exemplary embodiment shown in FIGS. 1(*a*), (*b*) and (*c*). That is, in the antenna device 100 shown in FIGS. 15(*a*) and (*b*), four passive conductor sections 101 to 104, and four passive conductor sections 105 to 108 are arranged at both edge side portions of the patch antenna 5, respectively. The four passive conductor sections 101 to 104 arranged at one edge side portion (at the left side in FIG. 15(*a*)) of the patch antenna 5 have the same structure to each other. In addition, the four passive conductor sections 105 to 108 arranged at the other edge side portion (at the right side in FIG. 15(*a*)) of the patch antenna 5 have the same structure to each other. The four passive conductor sections 101 to 104 and the four passive conductor sections 105 to 108 are arranged symmetrically to each other. For this reason, the passive conductor section 108 only will be explained. The explanation of the other passive conductor sections is omitted.

The passive conductor section 108 has an electric power absorbing passive element 111. The electric power absorbing passive element 111 has the same shape and size of each of the electric power absorbing passive elements 21 and 24 used in the antenna device 1 according to the first exemplary embodiment.

One end of a chip resistor 112 is connected to approximately a central section at the edge portion side of the dielectric substrate in the electric power absorbing passive element 111. The other end of the chip resistor 112 is connected to the front-surface conductor plate 3. The chip resistor 112 is a small sized resistance element to be used for the surface mounting, like the chip resistor 77 shown in FIG. 13.

When receiving electric power, the electric power absorbing passive element 111 excites and a voltage potential difference is generated between the electric power absorbing passive element 111 and the front-surface conductor plate 3. As a result, a current flows between the electric power absorbing passive element 111 and the front-surface conductor plate 3 through the chip resistor 112. When the current flows, the chip resistor 112 generates heat energy in order to consume the electric power absorbed by the electric power absorbing passive element 111.

The antenna device 100 having the structure shown in FIGS. 15 (*a*) and (*b*) has the same action and effects of each of the antenna devices 1 and 30 according to the first exemplary embodiment shown in FIGS. 1(*a*), (*b*) and (*c*) and the second exemplary embodiment shown in FIG. 3. It is possible to determine the position of the connection node of the chip resistor 112 in the electric power absorbing passive element. It is preferable to connect the chip resistor 112 with the area at the edge portion of the dielectric substrate in the electric power absorbing passive element, as shown in FIGS. 15(*a*) and (*b*).

Further, it is acceptable to connect the resistance element to the node between the electric power absorbing passive element and the back surface conductor plate 4. Specifically, the resistance element is embedded (laminated) in the inside of the dielectric substrate 2, and each of the terminals of the resistance element is connected directly or through a conductive member to the electric power absorbing passive element and the back surface conductor plate 4. It is also possible for the example shown in FIG. 13 to have the same structure.

(3) The structure of the passive conductor sections shown in FIG. 14 and the FIGS. 15(*a*) and (*b*) is an example. It is therefore possible to have a desired shape and location of the passive conductor sections. It is not always necessary to form the passive element by using a patch shaped conductor.

When the passive conductor sections are composed of the electric power absorbing passive elements and the re-radiating passive elements, it is possible to optionally determine the number of the passive elements, the shape of the passive element, the arrangement of the passive elements and the method of connecting them. That is, it is sufficient for the electric power absorbing passive element to absorb moderately electric power, and for the re-radiating passive element to radiate radio wave (preferably, radiate vertically polarized wave) in a direction which is different from the main polarization direction. However, it is preferable to arrange the passive elements so that the electric power absorbing passive element is arranged close to the patch antenna as compared with the position of the re-radiating passive element.

It is possible to use various connection methods capable of connecting the electric power absorbing passive element with the re-radiating passive element at high frequency. For example, there is a method of using an electromagnetic coupling, etc. capable of indirectly connecting them and transmitting electric power. The connection method using microstrip lines is an example only. It is possible to use another method of connecting them through a conductive member instead of using such a microstrip line. In this case, it is preferable to use such a microstrip line in order to connect them in view of efficiently absorbing electric power, transmitting the absorbed electric power to the re-radiating passive element, and re-radiating the transmitted electric power by the re-radiating passive element with high efficiency.

(4) It is not necessary for the main polarization direction of the electric power absorbing passive element to coincide exactly with the main polarization direction of the batch antenna 5. It is sufficient to have a range which adequately shows the function of absorbing a part of electric power in main polarization direction radiated from the patch antenna 5.

It is not always necessary for the main polarization direction of the re-radiating passive element to be perpendicular to the main polarization direction of the patch antenna 5. It is possible to determine the main polarization direction of the re-radiating passive element so long as the main polarization direction of the re-radiating passive element is different from the main polarization direction of the patch antenna 5. However, it is preferable to have a difference (crossing angle) in main polarization direction between the re-radiating passive element and the patch antenna 5 as large as possible. For this reason, it is more preferable for the re-radiating passive element to be perpendicular to the main polarization direction of the patch antenna 5.

(5) It is not necessary to arrange the passive conductor sections at both sides of the patch antenna 5. It is acceptable to arrange the passive conductor section at one side of the patch antenna 5 only. Further, it is possible to optionally determine the number of the passive conductor sections to be arranged around the patch antenna 5.

(6) It is possible to have a structure without using any structural member (for example, the re-radiating passive element 22 shown in FIG. 1(*a*), the chip resistor 112 shown in FIGS. 15(*a*) and (*b*)) which consumes absorbed electric power. That is, it is possible for a minimum structure only having the electric power absorbing passive element to suppress directive disturbance. However, it is preferable to have the structural member capable of consuming absorbed electric power in order to suppress directive disturbance stably with high efficiency.

(7) It is possible to optionally determine the shape and arrangement position of each of the passive elements 51*a*, 51*b*, . . . forming the passive element array 41 in the antenna device 40 (FIGS. 6 (*a*) and (*b*)) according to the third exemplary embodiment. For example, it is possible to determine a desired number of not less than 2 as the number of the passive elements forming each of the passive element arrays 51, 52, 53 and 54. Further, it is also possible to optionally determine the number of the passive element arrays in the element arrangement interval dx and the array arrangement interval dy, the number of the arrays in the y axis direction within a range capable of obtaining the desired characteristics.

It is possible to arrange one passive element array in the y axis direction, instead of arranging a plurality of the passive element arrays. However, it is preferable to arrange a plurality of the passive element arrays in the y axis direction, instead of arranging one passive element array, in order to obtain a high performance of the antenna device 40.

(8) The antenna device 40 according to the third exemplary embodiment has the structure in which each of the passive elements 51*a*, 51*b*, . . . is connected through the transmission line to transmit absorbed surface wave energy to the one node (the re-outputting position of the main connection line 63), and consume the transmitted surface wave energy. However, it is not always necessary to connect each of the passive elements 51*a*, 51*b*, . . . through the transmission line. It is possible for each of the passive elements 51*a*, 51*b*, . . . to absorb and consume surface wave energy, independently.

For example, it is possible to connect each of the passive elements 51*a*, 51*b*, . . . with the corresponding re-radiating passive element to perform re-radiation, independently, like the passive conductor sections used in the first exemplary embodiment. Still further, it is possible to connect each of the passive elements 51*a*, 51*b*, . . . to the terminal resistor in order to perform heat consumption, for example.

However, this method, which consumes surface wave energy by using each of the passive elements 51*a*, 51*b*, . . . independently, has a drawback from the viewpoint of the arrangement space because of having a complicated structure to perform energy consumption. It is therefore preferable to consume surface wave energy absorbed by each of the passive elements 51*a*, 51*b*, . . . collectively.

It is possible for the third exemplary embodiment to use various connection methods to connect each of the passive elements with the energy consuming member so long as it is possible to connect them at high frequency.

(9) The structure disclosed by each of the exemplary embodiments is an example only. It is therefore possible to use another shape of each of the patch radiating elements 6 to 9, another number of the patch radiating elements 6 to 9 forming the patch antenna 5, and another method of arranging the patch radiating elements 6 to 9.

(10) The first exemplary embodiment and the second exemplary embodiment show the structure in which the conductive plate (the front surface conductor plate 3 and the back surface conductor plate 4) formed on both surfaces of the dielectric substrate 2. It is possible to eliminate the front-surface conductive plate 3. The third exemplary embodiment shows the structure in which no conductive plate is formed on the front surface of the dielectric substrate 2. However, it is possible for the structure of the third exemplary embodiment to have the conductive plate on the front-surface of the dielectric substrate 2, like the structure disclosed by the first and second exemplary embodiments.

REFERENCE SIGNS LIST

1, 30, 40, 80 and 100 . . . Antenna devices, 2 . . . Dielectric substrate, 3 . . . Front surface conductive plate, 4 . . . Back surface conductive plate, 5 . . . Patch antenna, 6 to 9 . . . Patch radiating elements, 11, 12 31-36, 81, 82 and 101 to 108 . . . Passive conductive sections, 21, 24, 91, 94 and 111 . . . Electric power absorbing passive elements, 22, 25, 72, 92 and 95 . . . Re-radiating passive elements, 23, 26, 93 and 96 . . . Microstrip lines, 41, 42, 71 and 76 . . . Passive element arrays, 42 . . . Passive element array, 51 . . . First array, 51*a*, 52*a*, 53*a* and 54*a* . . . First passive elements, 51*b*, 52*b*, 53*b* and 54*b* . . . Second passive elements, 51*c*, 52*c*, 53*c* and 54*c* . . . Third passive elements, 51*d*, 52*d*, 53*d* and 54*d* . . . Fourth passive elements, 52 . . . Second array, 53 . . . Third array, 54 . . . Fourth array, 56 . . . First transmission line, 57 . . . Second transmission line, 58 . . . Third transmission line, 59 . . . Fourth transmission line, 61 . . . First sub-connection line, 62 . . . Second sub-connection line, 63 . . . Main connection line, 65 . . . Electric power consuming transmission line, and 77 and 112 . . . Chip resistors.

The invention claimed is:

1. An antenna device comprising:

a dielectric substrate;

a patch antenna, formed on the dielectric substrate, comprising at least a patch radiating element to which electric power is fed, a main polarization direction of the patch antenna being a predetermined direction on a surface of the dielectric substrate;

at least a first passive element formed between the patch antenna and one edge portion in both edge portions of the dielectric substrate in the main polarization direction on the surface on which the patch antenna is formed; and an energy consuming member formed in the first passive element in order to consume electric energy generated in the first passive elements excited by outside electric field, and the first passive element and the energy consuming member being formed on a same plane.

2. An antenna device comprising:

a dielectric substrate;

a patch antenna, formed on the dielectric substrate, comprising at least a patch radiating element to which electric power is fed, a main polarization direction of the patch antenna being a predetermined direction on a surface of the dielectric substrate;

first passive elements formed between the patch antenna and one edge portion in both edge portions of the dielectric substrate in the main polarization direction on the surface on which the patch antenna is formed; and at least an array section comprising a plurality of the first passive elements formed, on the surface of the dielectric substrate on which the patch antenna is formed, between the patch antenna and at least one edge portion in both edge portions in the main polarization direction of the dielectric substrate, and wherein the first passive elements are arranged at a predetermined arrangement interval along the main polarization direction, and the first passive elements in the array sections are connected together through connection members, and an energy consuming member is formed at a predetermined position of the connection member in order to consume electric energy generated in the first passive elements excited by outside electric field.

3. The antenna device according to claim 1, wherein the first passive element is formed to resonate at a frequency within a predetermined frequency range including an operating frequency of the patch antenna.

4. The antenna device according to claim 2, wherein the energy consuming member is a second passive element corresponding to the first passive element so that the first passive element is connected with the second passive element by using an electromagnetic coupling.

5. The antenna device according to claim 4, wherein the second passive element is formed to resonate at a frequency within the frequency range, and a main polarization direction of the second passive element when the second passive element resonates is different from the main polarization direction of the dielectric substrate.

6. The antenna device according to claim 4, wherein the second passive elements are connected to the corresponding first passive elements through microstrip lines.

7. The antenna device according to claim 1, wherein the energy consuming member is a resistor circuit comprising a resistance element electrically connected to the corresponding first passive element and being capable of consuming the electric energy.

8. The antenna device according to claim 7, wherein the resistance element is a chip resistor.

9. The antenna device according to claim 1, wherein the energy consuming member is a transmission line connected with the corresponding first passive elements by using an electromagnetic coupling.

10. The antenna device according to claim 1, wherein the first passive element has a direction of a main polarized wave component during the resonance which is approximately equal to the main polarization direction of the dielectric substrate.

11. The antenna device according to claim 1, wherein at least one first passive element is formed, on the surface of the dielectric substrate on which the patch antenna is formed, between the patch antenna and both edge portions in the main polarization direction of the dielectric substrate.

12. The antenna device according to claim 2, wherein the energy consuming member is a transmission line connected with the corresponding first passive elements by using an electromagnetic coupling.

13. The antenna device according to claim 2, wherein the first passive element has a direction of a main polarized wave component during the resonance which is approximately equal to the main polarization direction of the dielectric substrate.

14. The antenna device according to claim 2, wherein at least one first passive element is formed, on the surface of the dielectric substrate on which the patch antenna is formed, between the patch antenna and both edge portions in the main polarization direction of the dielectric substrate.

* * * * *